US005862714A

United States Patent [19]

Fujimoto

[11] Patent Number: 5,862,714

[45] Date of Patent: Jan. 26, 1999

[54] APPARATUS FOR POSITIONING SWITCH KNOB

[75] Inventor: Takuya Fujimoto, Osaka, Japan

[73] Assignee: Cateye Co., Ltd., Japan

[21] Appl. No.: 863,413

[22] Filed: May 27, 1997

Related U.S. Application Data

[63] Continuation of Ser. No. 541,211, Oct. 12, 1995, abandoned.

[30] Foreign Application Priority Data

Oct. 18, 1994 [JP] Japan ..... 6-252018

[51] Int. Cl.[6] ..... G05G 5/06; H01H 15/02

[52] U.S. Cl. ..... 74/527; 200/548

[58] Field of Search ..... 74/527; 200/548, 200/547

[56] References Cited

U.S. PATENT DOCUMENTS

| | | | |
|---|---|---|---|
| 3,242,297 | 3/1966 | Piber . | |
| 4,190,754 | 2/1980 | Kilar | 74/527 X |
| 4,441,000 | 4/1984 | Suwa | 200/548 |
| 4,506,119 | 3/1985 | Tanabe . | |
| 4,994,636 | 2/1991 | Wang | 200/548 |
| 5,147,990 | 9/1992 | Dionisio, Jr. et al. | 200/548 X |
| 5,315,079 | 5/1994 | Gierut . | |

FOREIGN PATENT DOCUMENTS

| | | |
|---|---|---|
| 29 00 726 | 7/1979 | Germany . |
| 107118 | 1/1989 | Taiwan . |

OTHER PUBLICATIONS

Office Action from the Patent Office of the People's Republic of China dated Apr. 29, 1997 and English Translation thereof.

*Primary Examiner*—Charles A. Marmor
*Assistant Examiner*—MaryAnn Ann Battista
*Attorney, Agent, or Firm*—Olson & Hierl, Ltd.

[57] ABSTRACT

In a lamp body to which a switch knob is attached, an opening corresponding to the switch knob is formed. Opening has opposing sidewalls, and on each of the sidewalls, three grooves are provided. On one surface of a knob body of the switch knob, a pair of projecting pieces are provided spaced from each other by such a distance that allows the projecting pieces to be in contact with the sidewalls of the opening, and at each of the projecting pieces, a beam portion is formed. On each of the beam portions, a projection is provided on the outer surface, and stable engagement with the vertical groove is realized.

5 Claims, 8 Drawing Sheets

APPARATUS FOR POSITIONING SWITCH KNOB

This application is a continuation, of application Serial No. 08/541,211 filed Oct. 12, 1995 now abandoned.

BACKGROUND OF THE INVENTION

1. Field of the Invention

The present invention relates to an apparatus for positioning a switch knob, and more specifically, to an apparatus for positioning a switch knob used for controlling on/off or the like of a battery feeded head lamp attached on a bicycle or the like.

2. Description of the Background Art

FIG. 7 is a side view showing a head lamp 101 employing a conventional positioning apparatus, attached on a handle 107 of a bicycle 143.

FIG. 8 shows a specific structure of the head lamp 101 attached on a handle 7 of FIG. 7, FIG. 9 is a front view and FIG. 10 is a rear view thereof.

Referring to these figures, an attachment part 102 consists of an upper member 109 and a lower member 111 which are rotatable around a pin 145. When attached to handle 107 of a bicycle, attachment screw 117 is removed, upper member 9 and lower member 111 are rotated about the pin 45 with their end portions expanded, and attachment part 102 is attached on the handle 107 of a bicycle with a rubber 47 wound around the handle 107. Thereafter, attachment screw 117 is fastened, so that a force gripping handle 107 is applied to the upper and lower members 109 and 111, and hence the attachment part 102 is firmly attached on handle 107 with rubber 147 interposed.

On a lamp body 125 at a rear portion of head lamp 101, a switch knob 103 for controlling on/off of the lamp is provided, which is operated referring to an indication mark 105. An attachment part 113 is attached on a lower portion of head lamp 101 by means of an attachment screw or the like. At a rear portion of attachment part 113, a lever 115 used for attachment/detachment to and from the attachment part 102 is provided.

FIG. 11 is a perspective view of switch knob 103 of FIG. 10 separated from lamp body 125 and a portion of the lamp body 125 viewed from the inside of the head lamp 101.

Referring to the figure, there is a rectangular opening 119 in lamp body 125. Opening 119 has opposing sidewalls 160*a* and 160*b*, the sidewall 160*a* is provided with two vertical grooves 161*a* and the sidewall 160*b* is provided with two vertical grooves 161*b*, which grooves each has semi-circular cross section and extending in thickness direction of the plate of the lamp body 125. At the opening 119 on the side of the lamp body 125, a switch plate 149 having a bent portion, and a terminal plate 151 positioned above a tip end of switch plate 149 are provided. When a switch plate 149 is brought into contact with terminal plate 151, a drive battery contained in head lamp 101 is electrically connected to the lamp, and the lamp is turned on.

Meanwhile, on the inner surface of a knob body 127 of switch knob 103, a pair of first projecting pieces 153*a*, 153*b* and a pair of second projecting pieces 157*a* and 157*b* are attached. The space between the first projecting piece 153*a* and the second projecting piece 157*b*, and the distance between the first projecting piece 53*b* and the second projecting piece 157*a* correspond to the space between opposing sidewalls 160*a* and 160*b* of the opening 119.

On the outer surfaces of the first projecting pieces 153*a* and 153*b*, semi-spherical projections 155*a* (not shown) and 155*b* are provided respectively. Near the tip ends of the second projecting pieces 157*a* and 157*b*, guide portions 137*a* and 137*b* having a triangular cross section are formed in a direction parallel to the upper surface of the knob body 127. At a central portion of the knob body 127, a third projecting piece 159 facing toward the switch plate 149 is attached.

FIG. 12 is a perspective view showing the switch knob 103 fitted in the opening 119, from the state of FIG. 11.

Referring to the figure, guide portions 137*a* and 137*b* formed at the second projecting pieces 157*a* and 157*b* respectively are engaged with the inner surface of lamp body 125 at the edges of opening 119, and guide sliding operation of switch knob 103 in the direction of the arrow. Projections 155*a* and 155*b* formed at the first projecting pieces 153*a* and 153*b*, respectively, engage with one of the vertical grooves 161*a* and one of the vertical grooves 161*b*, respectively. In the figure, switch knob 103 is positioned corresponding to a power off state. When the switch knob 103 slides in the direction of the arrow from this state, each of the projections 155*a* and 155*b* move to and engage with vertical grooves which are next to the vertical grooves with which the projections have been engaged, and the position of the switch knob 103 is stabilized. As the switch knob 103 is moved, the third projecting piece 159 projecting from the central portion of knob body 127 to the direction of the switch plate 149 also moves in the direction of the arrow, pushes up the tip end of switch plate 149, so that the tip end is brought into contact with the terminal plate 151. Therefore, the power is turned on and light is emitted from the head lamp 101.

In the conventional apparatus for positioning the switch knob as described above, it is difficult to have appropriate response of clicking when the knob is slid, since projections 155*a* and 155*b* engaging with vertical grooves 161*a* and 161*b* are attached on plate shaped projecting pieces 153*a* and 153*b* which pieces each have one end fixed on the knob body 127 and appropriate engaging force cannot be generated as the position of the projections must be on the side of the knob body 127. If the projections 155*a* and 155*b* are to be provided at tip ends of the first projecting pieces 153*a* and 153*b*, thickness of the first projecting pieces 153*a* and 153*b* must be increased. Further, since the first projecting pieces 153*a* and 153*b* have plate shape, they cannot be formed accurately by resin molding.

Therefore, projections 155*a* and 155*b* cannot be fitted with high precision in the vertical grooves 161*a* and 161*b*, and the projections cannot apply appropriate pressing force. As a result, good response of clicking cannot be obtained by the positioning apparatus.

SUMMARY OF THE INVENTION

The present invention was made to solve the above described problems, and its object is to provide an apparatus for positioning a switch knob which can surely provides appropriate click response.

The above described object can be attained by the apparatus for positioning a switch knob in accordance with the present invention including a body, on which the switch knob is attached, having an opening corresponding to the switch knob; at least two grooves provided in the thickness direction of the body, at a portion of a sidewall of the opening; a switch knob body which is a main portion of the switch knob and having a shape appropriate for covering the opening; a pair of projecting pieces provided projecting from one surface of the switch knob body and spaced from each other by such a distance that allows the projecting pieces to be in contact with the sidewalls of the opening; a beam portion having opposing ends supported, formed in at least one of the pair of projecting pieces; and a projection formed at the beam portion and which can be fitted in one of the grooves.

In the apparatus for positioning a switch knob structured as described above, a beam portion having opposing ends supported is provided on a pair of projecting pieces provided projecting from one surface of the switch knob body, and a projection formed at the beam portion engages with the groove, so that stable engagement between the groove and the projection is realized, and satisfactory response can be obtained when the switch knob is positioned.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
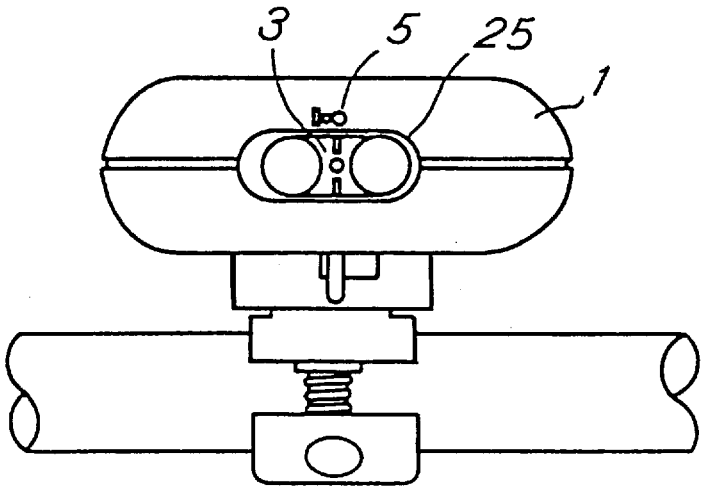
FIG. 1 shows how a head lamp incorporating the apparatus for positioning a switch knob in accordance with one embodiment of the present invention is attached.
Figure 10:
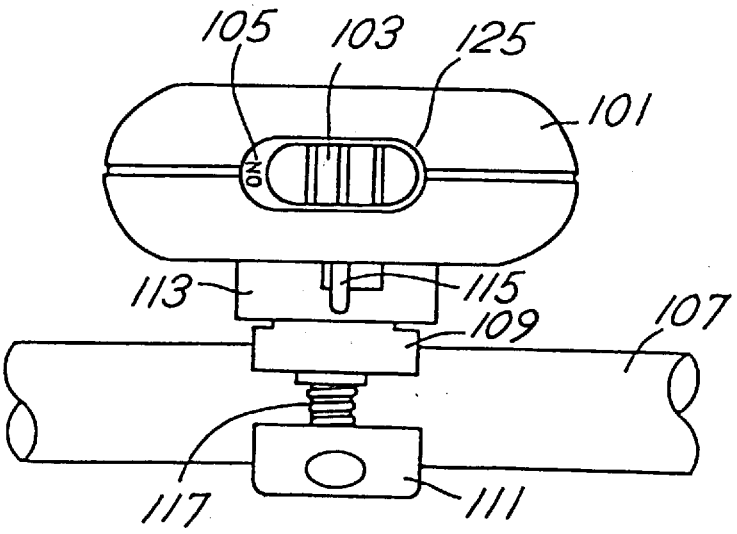
FIG. 10 PRIOR ART
FIG. 10 is a rear view of the head lamp 101 in the state of FIG. 8.
Figure 11:
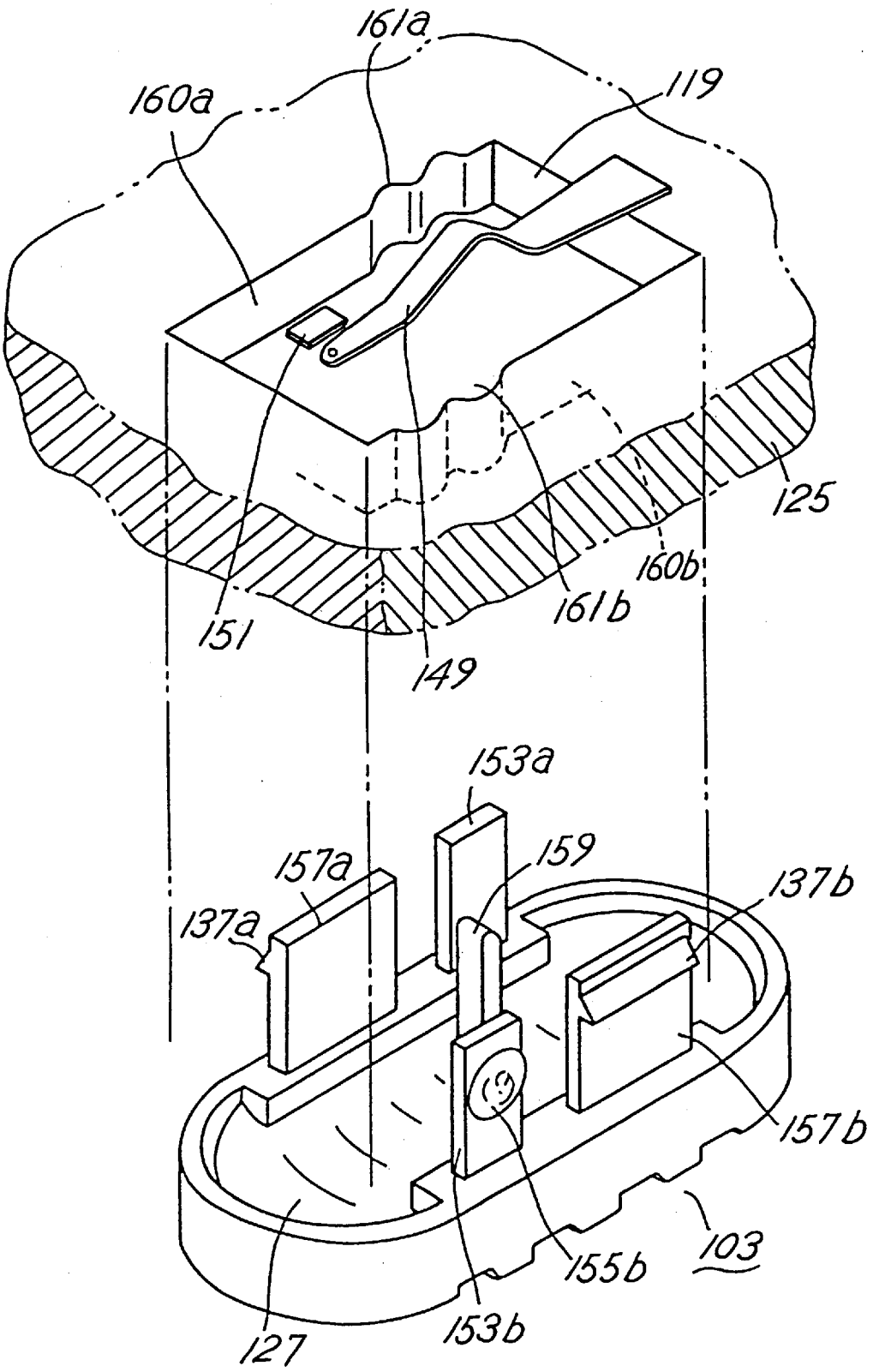
FIG. 11 PRIOR ART
FIG. 11 is a perspective view showing a switch knob 103 of FIG. 10 separated from lamp body 125 and a portion of lamp body 125 viewed from the inside of head lamp 101.
Figure 12:
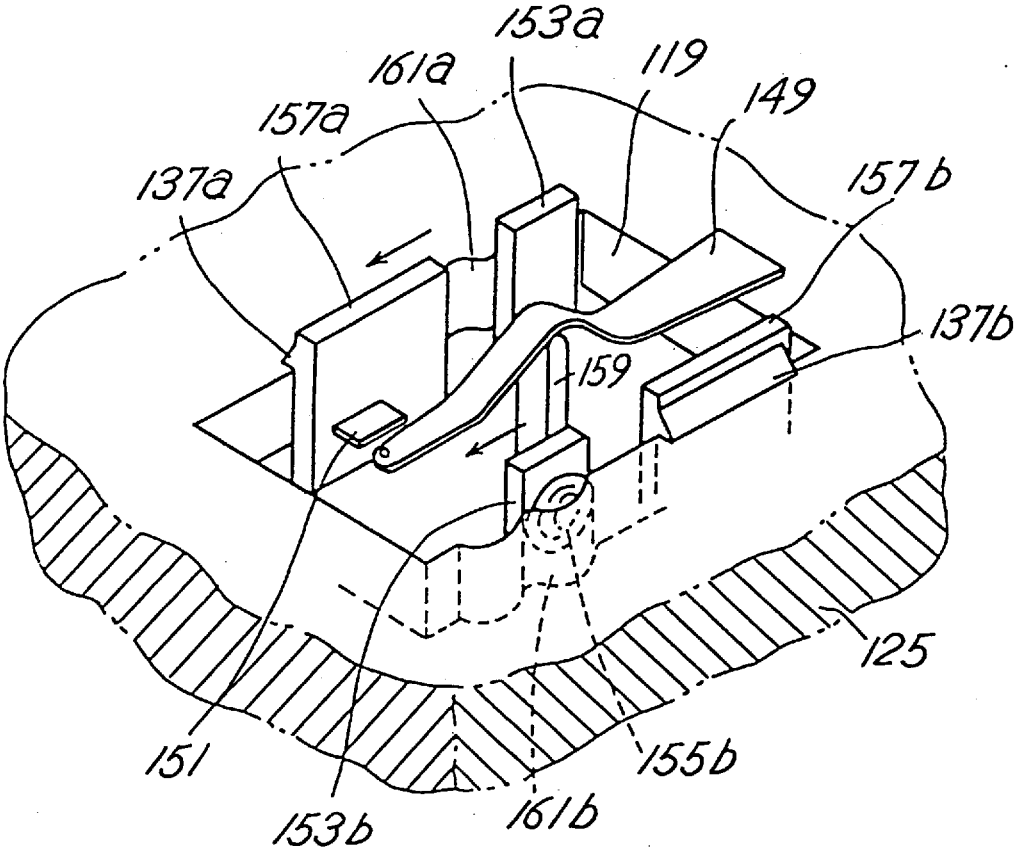
FIG. 12 PRIOR ART
FIG. 12 is a perspective view showing the switch knob 103 fitted in opening 119 of lamp body 125, from the state of FIG. 11.

FIG. 1 is a rear view showing how a head lamp incorporating the apparatus for positioning a switch knob in accordance with one embodiment of the present invention is attached, which corresponds to FIG. 10 of the prior art.

Referring to the figure, at a lamp body 25 at the rear portion of head lamp 1, there is provided a switch knob 3 for changing, in three steps, the state of electrical connection of the lamp, by sliding in lateral direction with reference to an indication mark 5. Other portions are similar to those of the prior art shown in FIG. 10. Therefore, description thereof is not repeated.

Figure 2:
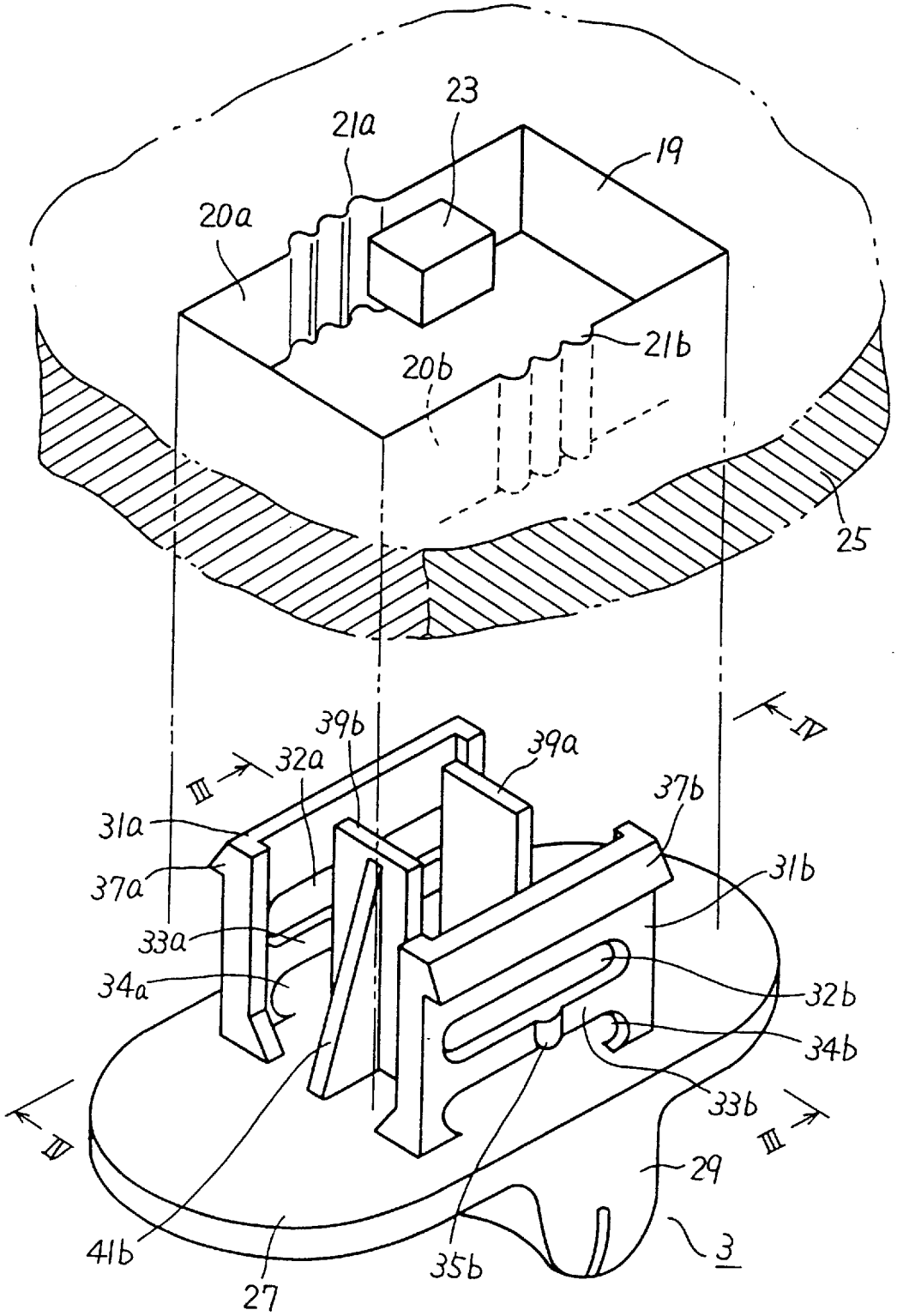
FIG. 2 is a perspective view of a switch knob 3 separated from a lamp body 25 and a portion of a lamp body 25 viewed from the inside of the head lamp 1 of FIG. 1.
Figure 3:
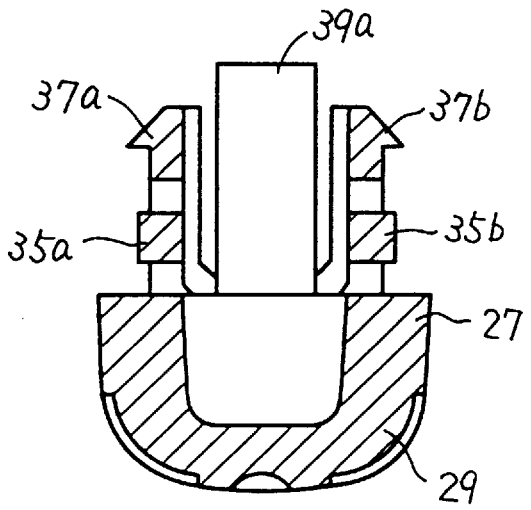
FIG. 3 is a cross section taken along the line III—III of FIG. 2.
Figure 4:
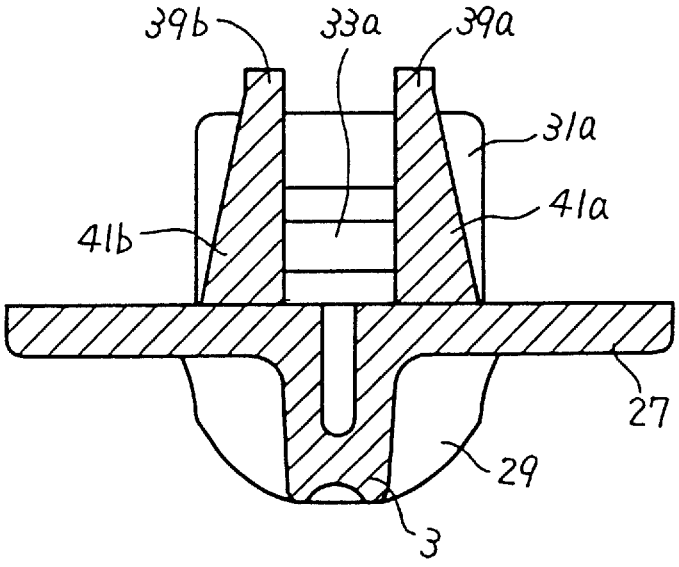
FIG. 4 is a cross section taken along the line IV—IV of FIG. 2.

FIG. 2 is a perspective view showing switch knob 3 of FIG. 1 separated from lamp body 25 and a portion of lamp body 25 viewed from the inside of head lamp 1. FIG. 3 is a cross section taken along the line III—III of FIG. 2, and FIG. 4 is a cross section taken along the line IV—IV of FIG. 2.

Referring to the figures, as in the prior art, there is a rectangular opening 19 formed in lamp body 25. Opening 19 has opposing sidewalls 20*a* and 20*b*, and the sidewall 20*a* has three vertical grooves 21*a* at the central portion and sidewall 20*b* has three vertical grooves 21*b* at the central portion, which groove each have semi-circular cross section and extending in the thickness direction of the opening 19. At a central portion of opening 19, a switch coupling portion 23 connected to a terminal is positioned.

On an outer surface of knob body 27 which is the main portion of switch knob 3, a knob piece 29 is provided, so as to facilitate sliding operation of switch knob 3. On the inner surface of knob body 27, a pair of first projecting pieces 31*a* and 31*b* are formed spaced from each other by such a distance that allows the projecting pieces to be in contact with the opposing sidewalls 20*a* and 20*b* of opening 19. In first projecting pieces 31*a* and 31*b*, elongate holes 32*a*, 32*b* and elongate holes 34*a* and 34*b* are provided parallel to each other and to the surface of the knob body 27, and by the provision of these holes, there are beam portions 33*a* and 33*b* formed with opposing ends supported. At an outer surface on the central portion of the beam portions 33*a* and 33*b*, projections 35*a* (not shown) and 35*b* having semi-circular cross section are formed. At the tip end portions of the first projecting pieces 31*a* and 31*b*, guide portions 37*a* and 37*b* having triangular cross sections are formed parallel to the upper surface of the knob body 27.

In a space sandwiched by the first projecting pieces 31*a* and 31*b*, a pair of plate shaped second projecting pieces 39*a* and 39*b* are formed from the inner surface of knob body 27. On the outside of the second projecting pieces 39*a* and 39*b*, support members 41*a* and 41*b* are attached, so as to reinforce the second projecting pieces 39*a* and 39*b* against bending.

The switch knob 3 including the first and second projecting pieces is formed integrally by resin molding.

Figure 5:
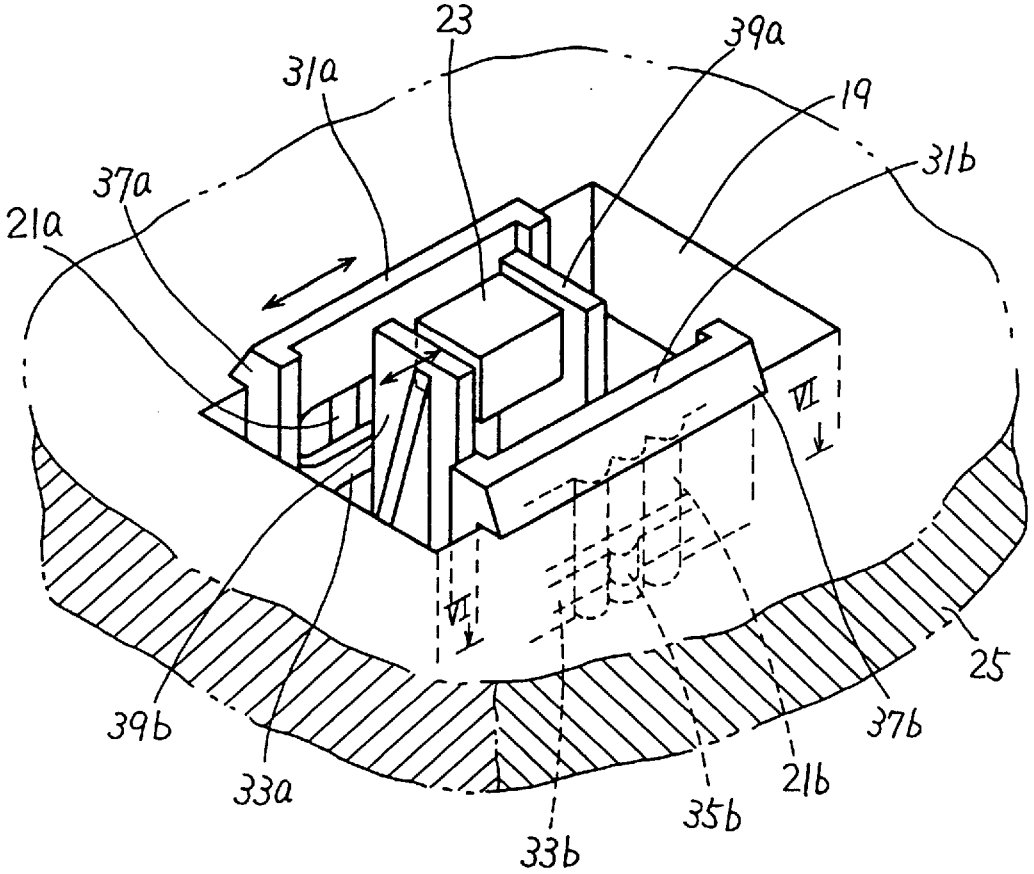
FIG. 5. shows a state when switch knob 3 is fitted in the opening 19 of lamp body 25, from the state of FIG. 2.
Figure 6:
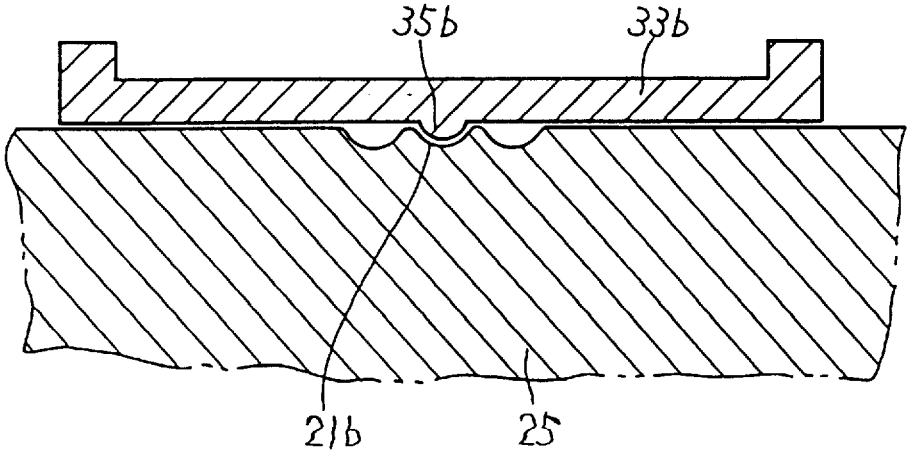
FIG. 6 is a cross section taken along the line VI—VI of FIG. 5.
Figure 7:
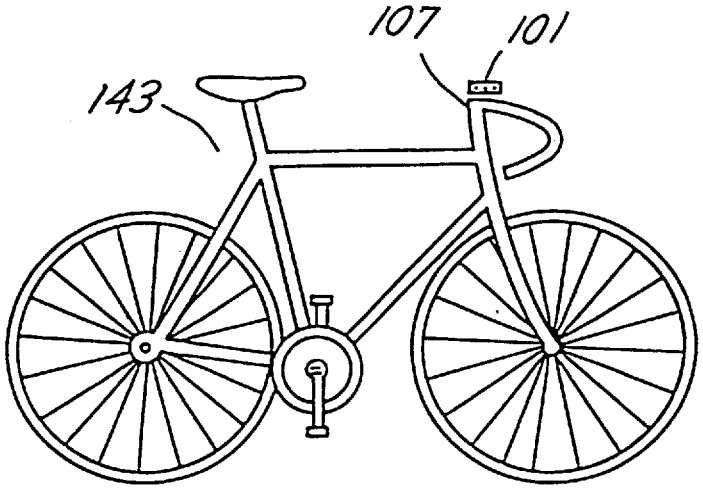
FIG. 7 PRIOR ART
FIG. 7 is a side view showing the head lamp employing the conventional positioning apparatus attached on a handle of a bicycle.
Figure 8:
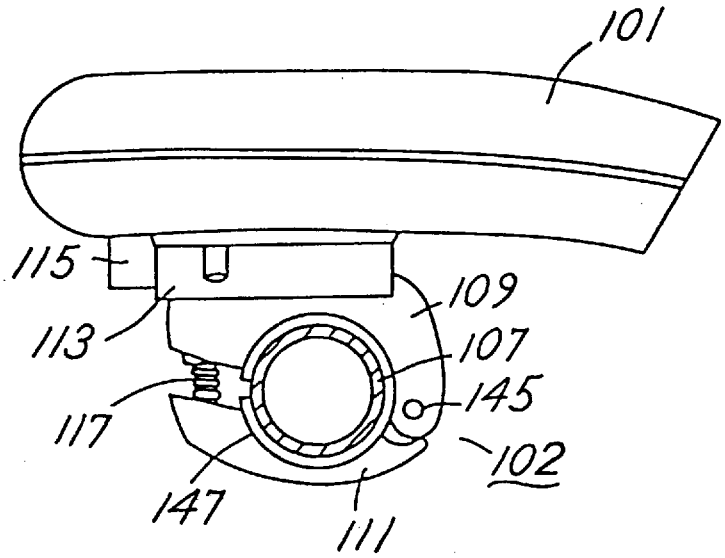
FIG. 8 PRIOR ART
FIG. 8 shows a specific structure of head lamp 101 attached to handle 107 of FIG. 7.
Figure 9:
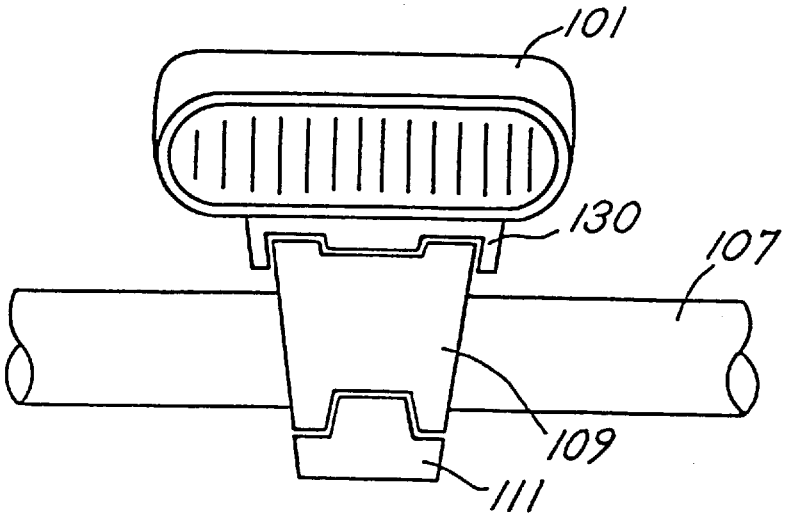
FIG. 9 PRIOR ART
FIG. 9 is a front view of the head lamp 101 in the state of FIG. 8.

FIG. 5 is a perspective view showing the switch knob 3 fitted in the opening 19 of lamp body 25, from the state of FIG. 2, and FIG. 6 is a cross section taken along the line VI—VI of FIG. 5.

Referring to the figure, guide portions 37*a* and 37*b* of the first projecting pieces 31*a* and 31*b* engage the inner surface of lamp body 25 at the edges of opening 19, and guide movement of switch knob 3 in the direction of the arrow. In this state, the projections 35*a* and 35*b* formed at the beam portions 33*a* and 33*b* of the first projecting pieces 31*a* and 31*b* respectively engage with any of the three vertical grooves 21*a* and any of the three vertical grooves 21*b* formed on the sidewalls of opening 19. In this example, the projections 35*a* and 35*b* are shown engaged with the central one of the three vertical grooves 21*a* and of 21*b*.

Meanwhile, the pair of second projecting pieces 39*a* and 39*b* are positioned sandwiching a switch coupling portion 23. When the switch knob 3 is slid in the direction of the arrow while it is engaged with the opening 19 of lamp body 25, projections 35*a* and 35*b* move from any of the grooves of the vertical grooves 21*a* and 21*b* with which the projections have been engaged to adjacent other groove and engaged therewith. At this time, since projections 35*a* and 35*b* are provided at beam portions 33*a* and 33*b* which have opposing ends supported, the projections engage with the vertical grooves 21*a* and 21*b* with satisfactory resiliency. Therefore, appropriate response of clicking and stable movement and stopping of the switch knob 3 are ensured. As the switch knob 3 is slid in this manner, the switch coupling portion 23 also moves in the direction of the arrow, sandwiched by the pair of second projecting pieces 39*a* and 39*b*. Thus the position of the switch coupling portion 23 changes, electrical connection between the power supply and the lamp in the head lamp 1 changes, and thus on/off of the lamp can be controlled.

Though there are three vertical grooves on each sidewall in the above described embodiment, the number of grooves may be two, four or more.

Though the second projecting pieces 39*a* and 39*b* sandwich the switch coupling portion 23 in the above described embodiment, the switch plate 49 and the terminal plate 51 of the prior art may be used.

Further, though projections 35*a* and 35*b* are engaged with the vertical grooves of opposing sidewalls of the opening 19 in the above described embodiments, the switch knob may be slid with the projection provided on only one of the projections and the grooves provided on only one of the sidewalls.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for changing the state of an electrical connection comprising, a body on which a switch knob is attached, and having an opening corresponding to said switch knob, said opening having sidewalls;

at least two grooves formed at a portion of one of said sidewalls of said opening, in a direction of thickness of said body;

a switch knob body which is a main portion of said switch knob and having a shape appropriate for covering said opening;

a pair of projecting pieces provided projecting from one surface of said switch knob body, spaced from each other by such a distance that allows each of the projecting pieces to be in contact with the sidewalls of said opening;

a beam portion having opposing ends supported, formed in at least one of said pair of projecting pieces;

a projection formed at said beam portion and engageable with one of said grooves;

an elongated guide portion having opposing ends supported, formed in at least one of said pair of projecting pieces to be engaged at an inner surface of said body at an edge portion of said opening, and a pair of second spaced apart projecting pieces fixed to and extending from the switch knob body, a switch coupling portion disposed between the pair of second spaced apart projecting pieces, said pair of second spaced apart projecting pieces engaging said switch coupling portion for moving the switch coupling portion when the switch knob body is moved.

2. The apparatus according to claim 1, wherein said opening has a rectangular shape and said sidewalls are opposed;

said two grooves are provided on each of the said sidewalls of said opening;

said beam portion is formed in each of said pair of projecting pieces;

each of said projections is engaged with one of said two grooves provided on each of the opposing sidewalls of said opening.

3. The apparatus according to claim 1 wherein each of said projecting pieces has two elongate holes arranged parallel to each other, and said beam portion is formed at a portion sandwiched by said two elongate holes.

4. The apparatus according to claim 1, wherein said guide portion is provided at a tip end of each of said pair of projecting pieces.

5. The apparatus according to claim 1, wherein said body is formed at a portion of a head lamp for a bicycle.

* * * * *